US007610660B2

(12) United States Patent
Minter

(10) Patent No.: US 7,610,660 B2
(45) Date of Patent: Nov. 3, 2009

(54) APPARATUS ON A DRAFTING SYSTEM OF A SPINNING ROOM MACHINE, FOR WEIGHTING DRAFTING SYSTEM ROLLERS

(75) Inventor: Franz-Josef Minter, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 56 days.

(21) Appl. No.: 11/907,355

(22) Filed: Oct. 11, 2007

(65) Prior Publication Data

US 2008/0087000 A1 Apr. 17, 2008

(30) Foreign Application Priority Data

Oct. 11, 2006 (DE) ..... 10 2006 048 742

(51) Int. Cl.
*D01H 5/46* (2006.01)

(52) U.S. Cl. ..... 19/266; 19/270

(58) Field of Classification Search ..... 19/266–285
See application file for complete search history.

(56) References Cited

U.S. PATENT DOCUMENTS

| | | | | |
|---|---|---|---|---|
| 4,510,648 | A | 4/1985 | Mori et al. | |
| 5,761,772 | A | 6/1998 | Clapp et al. | |
| 5,799,374 | A * | 9/1998 | Strobel et al. | 19/274 |
| 6,134,752 | A * | 10/2000 | Gohler et al. | 19/272 |
| 6,154,931 | A | 12/2000 | Corrales et al. | |
| 6,427,720 | B1 * | 8/2002 | Hayashi et al. | 137/554 |
| 6,469,500 | B1 * | 10/2002 | Schmitz et al. | 324/207.16 |
| 2003/0009133 | A1 * | 1/2003 | Ramey | 604/155 |
| 2003/0177848 | A1 | 9/2003 | Biester et al. | |
| 2004/0139851 | A1 * | 7/2004 | Moller et al. | 92/5 R |
| 2004/0187269 | A1 | 9/2004 | Moller et al. | |
| 2006/0242798 | A1 * | 11/2006 | Minter | 19/236 |
| 2008/0087000 | A1 | 4/2008 | Minter | |

FOREIGN PATENT DOCUMENTS

| | | | |
|---|---|---|---|
| DE | 19545923 | A1 | 8/1996 |
| DE | 103 14 428 | A1 | 10/2004 |

(Continued)

OTHER PUBLICATIONS

United Kingdom Intellectual Property Office Search Report, dated Dec. 21, 2007, issued for corresponding Great Britain Application No. GB0719790.8.

(Continued)

*Primary Examiner*—Shaun R Hurley
(74) *Attorney, Agent, or Firm*—Venable LLP; Robert Kinberg; Leigh D. Thelen

(57) ABSTRACT

In an apparatus on a drafting system of a spinning room machine, especially a draw frame, carding machine, combing machine or the like, for weighting the drafting system rollers, at least one pressure-medium cylinder with a piston is acted upon by pressure medium and is arranged so as to be axially movable inside a cylinder housing. A piston rod extends from piston passing through at least one cylinder cover that defines the cylinder housing at the end. In order to improve the apparatus, for determining the position of the piston with the piston rod, at least one inductive displacement sensor is integrated into the pressure-medium system, and the inductive displacement sensor is connected to an evaluation device.

24 Claims, 4 Drawing Sheets

FOREIGN PATENT DOCUMENTS

| | | | |
|---|---|---|---|
| DE | 10 2004 046 107 | A1 | 4/2006 |
| DE | 10 2005 004 908 | A1 | 8/2006 |
| DE | 10 2005 020 506 | A1 | 11/2006 |
| EP | 0166521 | A1 | 1/1986 |
| EP | 0338966 | A2 | 10/1989 |
| EP | 0 415 156 | A1 | 3/1991 |
| EP | 0422458 | A2 | 4/1991 |
| EP | 0 939 151 | A2 | 9/1999 |
| EP | 1081390 | A2 | 3/2001 |
| EP | 1 428 914 | A | 6/2004 |
| EP | 1428914 | A2 | 6/2004 |
| EP | 1 464 741 | A2 | 10/2004 |

OTHER PUBLICATIONS

Handbuch für elektrisches Messen mechanischer Größen ("Handbook for electric Measuring of mechanical Course"), Rohrbach, Christof, *VDI-Verlag GmbH Düsseldorf*, pp. 234-242 (1967).

German Patent Office Search Report, dated Apr. 18, 2007, issued for corresponding German Application No. 10 2006 048 742.7 (and English translation of Section C).

French Patent Office Search Report, dated Jul. 27, 2007, issued for French Application No. 0651508000 (and it's English translation), which corresponds to related U.S. Appl. No. 11/411,862.

United Kingdom Search Report, dated Aug. 7, 2006, issued in Application No. GB0608276.2, which corresponds to related U.S. Appl. No. 11/411,862.

* cited by examiner

APPARATUS ON A DRAFTING SYSTEM OF A SPINNING ROOM MACHINE, FOR WEIGHTING DRAFTING SYSTEM ROLLERS

CROSS REFERENCE TO RELATED APPLICATION

This application claims priority from German Patent Application No. 10 2006 048 742.7 dated Oct. 11, 2006, the entire disclosure of which is incorporated herein by reference.

BACKGROUND OF THE INVENTION

The invention relates to an apparatus on a drafting system of a spinning room machine, especially a draw frame, carding machine, combing machine or the like, for weighting the drafting system rollers.

It is known to provide, for weighting drafting system rollers, at least one pressure-medium cylinder with a piston which is acted upon by pressure medium and is arranged so as to be axially movable inside a cylinder housing and from which a piston rod extends, the piston rod passing through at least one cylinder cover that defines the cylinder housing at the end, there being an inductive sensor arrangement for determining the position of the piston with the piston rod.

In such a known apparatus (EP 1 428 914 A), a switching disc is frictionally mounted coaxially with the piston so as to be displaceable on the piston rod, which switching disc cooperates with a switch to determine the position of the piston. The switching disc is at least partly permanently magnetic in order to cooperate with an inductive sensor as a switch for determining the position of the piston. If a lap of fibre material then forms around the upper roller, the floating upper roller is pressed in the direction of the pressure-medium cylinder. The presser rod of the pressure-medium cylinder making contact with the upper roller consequently moves in the direction of its retracted end position. When the presser rod is retracted, the switching disc, which is frictionally mounted thereon, connects the switch and the drafting system is switched off. The drafting system can then be opened manually and the lap removed. The drafting system can then be brought into the operating position again by closing the weighting arm. In the known apparatus, the detection of a piston in a very specific position (lap monitoring) is effected by means of an inductive proximity switch. Such an inductive sensor has a closing contact which closes when the piston approaches a previously defined position and accordingly sends a lap monitoring defect signal to the control means. That position must be determined afresh every time the upper rollers are ground. A further substantial disadvantage is that it is not possible to detect the travel of the piston (up and down).

SUMMARY OF THE INVENTION

It is an aim of the invention to provide an improved apparatus on a drafting system for determining the position of the piston with the piston rod.

The invention provides an apparatus on a drafting system of a spinning room machine, for weighting the drafting system rollers, including at least one pressure-medium system having a pressure-medium cylinder with a piston which is acted upon by pressure medium and is arranged so as to be axially movable inside a cylinder housing and from which a piston rod extends, the piston rod passing through an end of the cylinder housing, wherein there is provided, within the pressure-medium system, at least one inductive displacement sensor, the inductive displacement sensor being connected to an evaluation device.

The apparatus according to the invention makes it possible to use control technology to monitor the movement of the piston, including the platform, in both directions, up and down, by means of the inductive displacement sensor. As a result of the travel of the piston in both directions, the position of the plunger core in the plunger coil changes, which consequently in turn produces a changed output signal to the control means. By virtue of the changed output signal, the control means is able to identify the movement of the piston in both directions. Furthermore, the control means is able to ascertain by means of the signals the path traveled by the piston. By means of that exact measurement and by means of the maximum value for the upward excursion of the upper roller caused by lap formation, which value is stored in the control means, the fault "lap formation" can be precisely identified. The value of the upward excursion up until a fault message is given can accordingly be freely programmable and can be changed as required. A further advantage of such distance measurement is that precise identification of both lap formation and wear to the upper rollers can be effected automatically by the control means using an inductive displacement sensor. Typically, the upper rollers of the drafting system are routinely provided with a resilient covering, for example of rubber or the like. When the machine is first started up with new upper rollers, the drafting system is closed and acted upon by compressed air. The inductive displacement sensor can ascertain the position of the piston and stores that value in the control means. The value ascertained can be used to calculate the roller diameter of a new upper roller, from which there is obtained, after subtraction of the maximum wear value (stored in the control means as a fixed or variable parameter), a minimum roller diameter. The minimum roller diameter can be likewise stored. As a result of the wear to and grinding of the upper rollers, that distance becomes increasing larger. By calibrating the inductive displacement sensor on each operation of closing the drafting system, the position can be ascertained afresh each time. The newly ascertained value forms the current diameter of the upper roller. The control means compares the currently ascertained diameter with the fixed programmed parameter for the wear or the stored value for the minimum upper roller diameter. The arrangement may be such that, when the minimum roller diameter of the upper roller is reached, the machine switches to fault mode and switches off. The upper rollers must be replaced by new rollers. Preferably, the machine can be started up again only when distance measurement indicates a roller diameter greater than the pre-set minimum roller diameter has been reached. Displacement measurement inside the presser arms in accordance with the invention achieves a wear-free and tolerance-independent measurement in both directions of the piston that is absolutely precise; also automatic monitoring of lap formation and of wear to the upper rollers is achievable. If necessary, all stored values relating to lap formation and the wear behaviour of the upper rollers can be retrieved from the control means for statistical purposes. Preferably, the machine cannot be started up with worn upper rollers. As a result, material wastage caused by worn upper rollers is not possible. A particular advantage is that the inductive displacement sensor is integrated into the pressure-medium system, with the result that substantial structural simplification is achieved. In a preferred embodiment, the inductive displacement sensor comprises a plunger core associated with the piston and a plunger coil associated with the inner wall of the cylinder housing.

As mentioned above, the inductive displacement sensor is within, for example, integrated into, the pressure-medium system, preferably within the cylinder housing.

In certain preferred embodiments, the inductive displacement sensor comprises a plunger core and a plunger coil. The plunger coil may be connected to the evaluation device by means of an electrical lead. Advantageously, the plunger core is movable and the plunger coil is in fixed position. Advantageously, the plunger core is arranged in an end region of an extension that is mounted on the piston. The extension, for example, a rod, may consist of plastics. Advantageously, the plunger core is arranged to move back and forth in a guide recess of the cylinder base. In some embodiments, the plunger core is in the form of a metal covering, for example, a metal coating, thin-walled metal cap, hollow cylinder or the like. In other embodiments, the plunger core is in the form of a solid metal cylinder. Advantageously, the plunger coil is in the form of a hollow cylinder. Advantageously, the outer wall surface of the plunger coil is in contact with the cylindrical inner wall surface of the guide recess. Advantageously, the cylindrical inner wall surface of the fixed plunger coil lies opposite and spaced apart from the cylindrical outer wall surface of the plunger core. In practice, the apparatus can be used for lap display and/or for displaying wear to the rollers. Advantageously, the inductive displacement sensor is arranged in a closed housing. Advantageously, the inductive displacement sensor is connected to an electrical evaluation device. Advantageously, the evaluation device is connected to an electronic control and regulation device. Advantageously, the inductive displacement sensor is an analog sensor. In some cases, the drafting system may comprise three upper rollers with three presser arms. It is also possible for the drafting system to comprise four upper rollers with four presser arms. Advantageously, the inductive displacement sensor is able to detect the movements of the piston in two directions. Advantageously, the electronic control and regulation device is able to ascertain the path changes of the piston. Advantageously, the maximum value for the excursion of the upper roller caused by lap formation is storable in the control and regulation device. Advantageously, the value of the excursion up until a fault message is given is freely programmable. Advantageously, the inductive displacement sensor is calibratable on each operation of closing the drafting system. In some embodiments, the electronic control and regulation device comprises a 4-channel evaluation device. Advantageously, measured values relating to lap formation and/or to the wear behaviour of the upper rollers are storable.

It is preferred that the plunger coil is fully encapsulated. In practice, the pressure-medium cylinder will typically contain a pressure chamber and, advantageously, the plunger coil seals the pressure chamber at the top.

The pressure-medium used in the apparatus of the invention will usually be compressed air. Whilst other pressure media may be used effectively, compressed air offers the advantages of simplicity and economy.

The invention also provides an apparatus on a drafting system of a spinning room machine, especially a draw frame, carding machine, combing machine or the like, for weighting the drafting system rollers, having at least one pressure-medium cylinder with a piston which is acted upon by pressure medium and is arranged so as to be axially movable inside a cylinder housing and from which a piston rod extends, the piston rod passing through at least one cylinder cover that defines the cylinder housing at the end, there being an inductive sensor arrangement for deter-mining the position of the piston with the piston rod, wherein for determining the position of the piston with the piston rod at least one inductive displacement sensor is integrated into the pressure-medium system consisting of the cylinder housing and the pressure-medium-actuatable piston, and the inductive displacement sensor is connected to an electrical evaluation device.

DETAILED DESCRIPTION OF CERTAIN PREFERRED EMBODIMENTS

Figure 1:
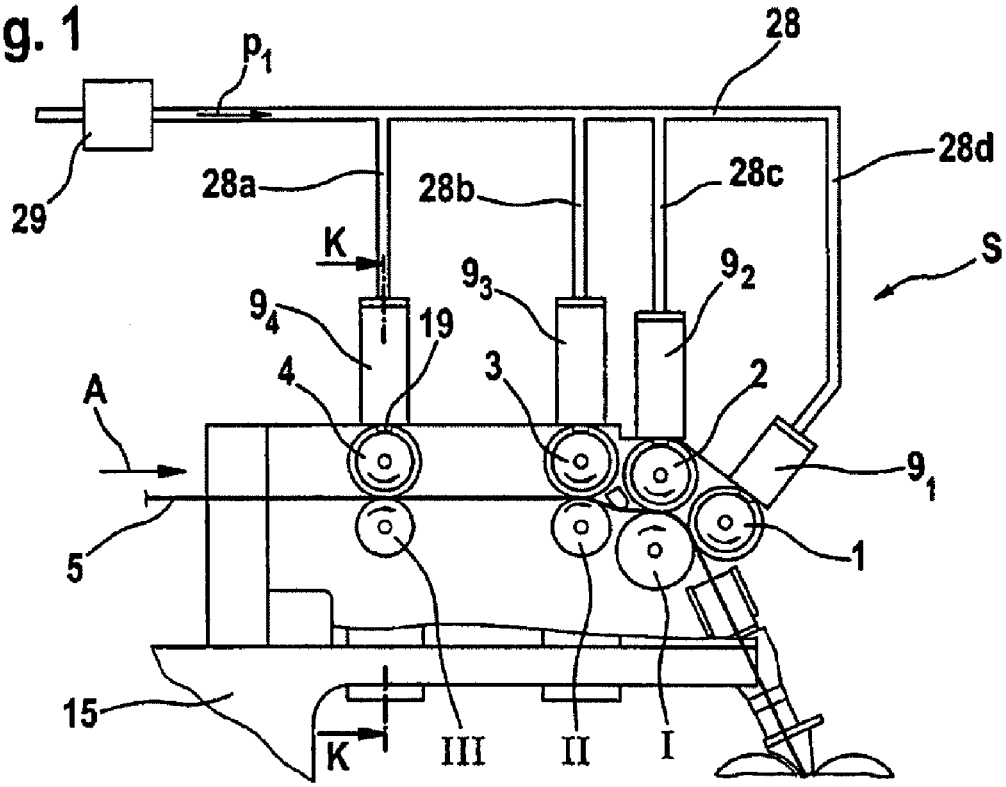
FIG. 1 is a diagrammatic side view of the drafting system of a draw frame having one embodiment of apparatus according to the invention.

With reference to FIG. 1, a drafting system S of a draw frame, for example a draw frame TC 03 made by Trützschler GmbH & Co. K.G. of Mönchengladbach, Germany. The drafting system S is configured as a 4 over 3 drafting system, that is to say it consists of three lower rollers I, II, III (I output lower roller, II middle lower roller, III input lower roller) and four upper rollers 1, 2, 3, 4. In the drafting system S, the drafting of the fibre bundle 5, which consists of a plurality of slivers, is carried out. The drafting operation is composed of the preliminary drafting operation and the main drafting operation. The roller pairs 4/III and 3/II form the preliminary drafting zone and the roller pairs 3/II and 1, 2/I form the main drafting zone. The output lower roller I is driven by the main motor (not shown) and thus determines the delivery speed. The input and middle lower rollers III and II are driven by a regulating motor (not shown). The upper rollers 1 to 4 are pressed against the lower rollers I, II, III by presser elements $\mathbf{9}_1$ to $\mathbf{9}_4$ (weighting device) in presser arms 11*a* to 11*d* which are pivotable about pivot bearings (see FIG. 3) and are thus driven by way of frictional engagement. The direction of rotation of the rollers I, II, III; 1, 2, 3, 4 is indicated by curved arrows. The fibre bundle 5, which consists of a plurality of slivers, runs in direction A. The lower rollers I, II, III are mounted in stands 14 (see FIG. 2) which are arranged on the machinery frame 15. Reference numeral 29 denotes a compressed air supply, with reference numerals 28*a*, 28*b*, 28*c* and 28*d* indicating channels communicating between air supply 29 and presser elements $\mathbf{9}_1$ to $\mathbf{9}_4$.

Figure 2:
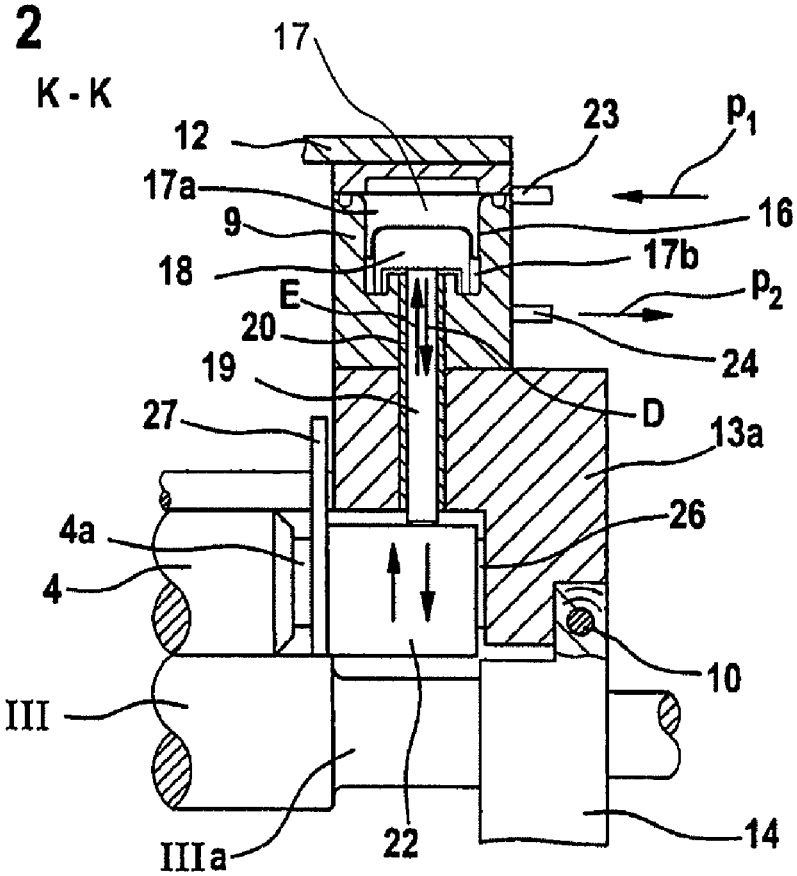
FIG. 2 shows a portion of FIG. 1 in section corresponding to K-K (FIG. 1) with a pneumatic upper roller weighting device.

In FIG. 2 there is shown in more detail the presser element $\mathbf{9}_4$, although presser elements $\mathbf{9}_1$ to $\mathbf{9}_3$ are of the same or essentially the same construction. According to FIG. 2, the pneumatic cylinder 9 is associated at the top with a support element 12 and at the bottom with a holding element 13*a*. The pneumatic cylinder 9 forms a cylinder unit with a cylinder cavity 17 having two portions 17*a* and 17*b* in which a piston 18 is guided by means of a presser rod 19 in a sliding bush 20. The roller journal 4*a* of the upper roller 4, passing through an opening in a holding bracket 27, engages in a bearing 22. The bearing 22 accommodating the upper roller 4 extends into a chamber between the presser rod 19 and the roller journal IIIa of the lower roller III. The bearing 22 is held by means of a shoulder 26 in the holding element 13*a*. A membrane 16 divides the cylinder cavity 17 in terms of pressure. In order that pressure is generated in the upper portion of the cylinder cavity 17, the latter can be supplied with compressed air $p_1$ by means of a compressed air connection 23 through line 28 to line 28*a* (see FIG. 1). The lower portion of the cylinder cavity 17 vents compressed air $p_2$ by means of a venting bore 24. The upper portion of the cylinder cavity 17 can be vented and the lower portion of the cylinder cavity 17 can be supplied with compressed air in corresponding manner. In operation, after a fibre bundle 5 has been guided over the lower rollers I, II, III, the presser arms 11 are pivoted into the operating position shown in FIG. 3 and fixed in that position by a fastening device (not shown), so that the presser rollers I, II, III are able to exert pressure. Such a pressing action is produced on the one hand by the fact that the presser rods 19 each rest on the corresponding bearing 22 and on the other hand because an overpressure has been generated in the cavity above the membrane 16. As a result, the presser rod 19 presses with its other end on the bearing 22 in order to create the mentioned pressing action between the upper roller 4 and the lower roller (drive roller) III. The presser rod 19 (piston rod) is displaceable in the direction of arrows D, E.

Figure 3:
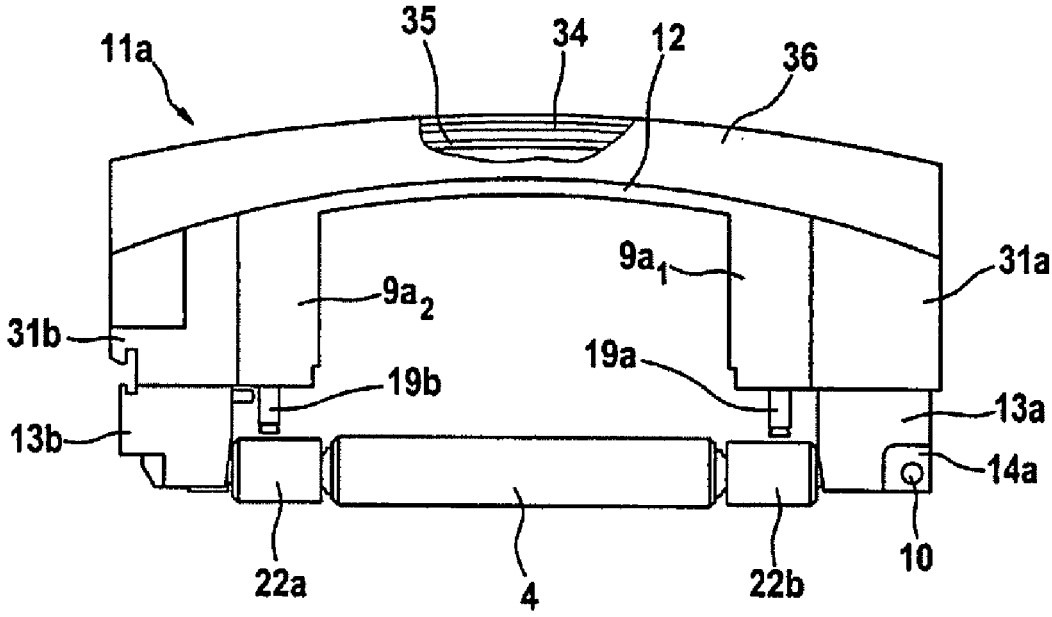
FIG. 3 is a front view of a presser arm having an integral housing and two presser rods.
Figure 3A:
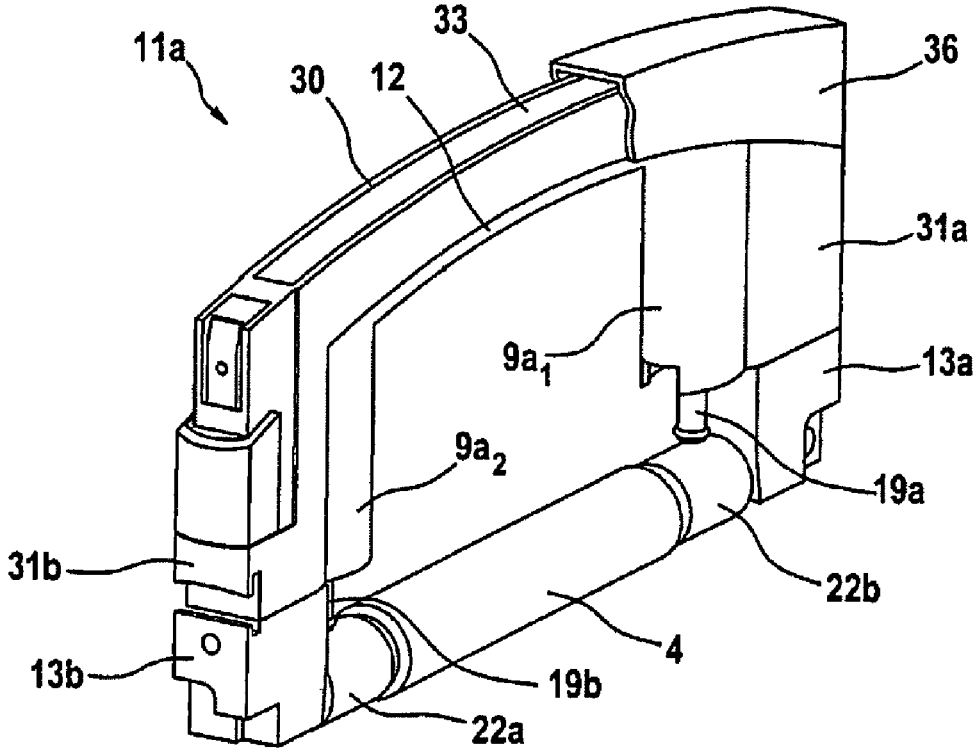
FIG. 3*a* is a perspective view of the presser arm according to FIG. 3.

In the embodiment shown in FIG. 3, 3*a*, the upper roller 4 is associated with a portal-shaped presser arm 11*a*. (The upper rollers 1 to 3 are associated with a corresponding presser arm 11—not shown). In this embodiment, the presser arm 11*a* is in the form of a housing 30 of glass-fibre-reinforced plastics and is produced by injection-moulding. The housing 30 is an integral component which is of unitary construction and comprises the support element 12, the two bodies of the presser elements $9a_1$ and $9a_2$ (pressure cylinders), two intermediate elements 31*a* and 31*b* and two holding elements 13*a* and 13*b*. The support element 12 is in the form of a channel 33 of approximately U-shaped cross-section that is open on one side, in the interior of which pneumatic lines 34 and electrical leads 35 are arranged. The open side of the channel 33 is closable by a removable cover 36, partly cut away in FIGS. 3 and 3*a*, which consists of glass-fibre-reinforced plastics, is approximately U-shaped in cross-section and is resilient so that it is attached to the channel 33 by a press-fit connection. The housing 30 is preferably formed in one piece. The integral housing 30, which combines all essential functional elements for holding and weighting the respective upper rollers 1 to 4, is in this way economical to produce. At the same time, the entire presser arm 11*a* to 11*d* is in simple manner pivotable about the pivot bearing 10 and can be locked and unlocked by a locking device (not shown). The presser rods 19*a* and 19*b* are relieved of load and thus raised from the bearings 22*a* and 22*b* of the upper roller 4 at distance $b_1$, $b_2$, respectively.

Figure 4:
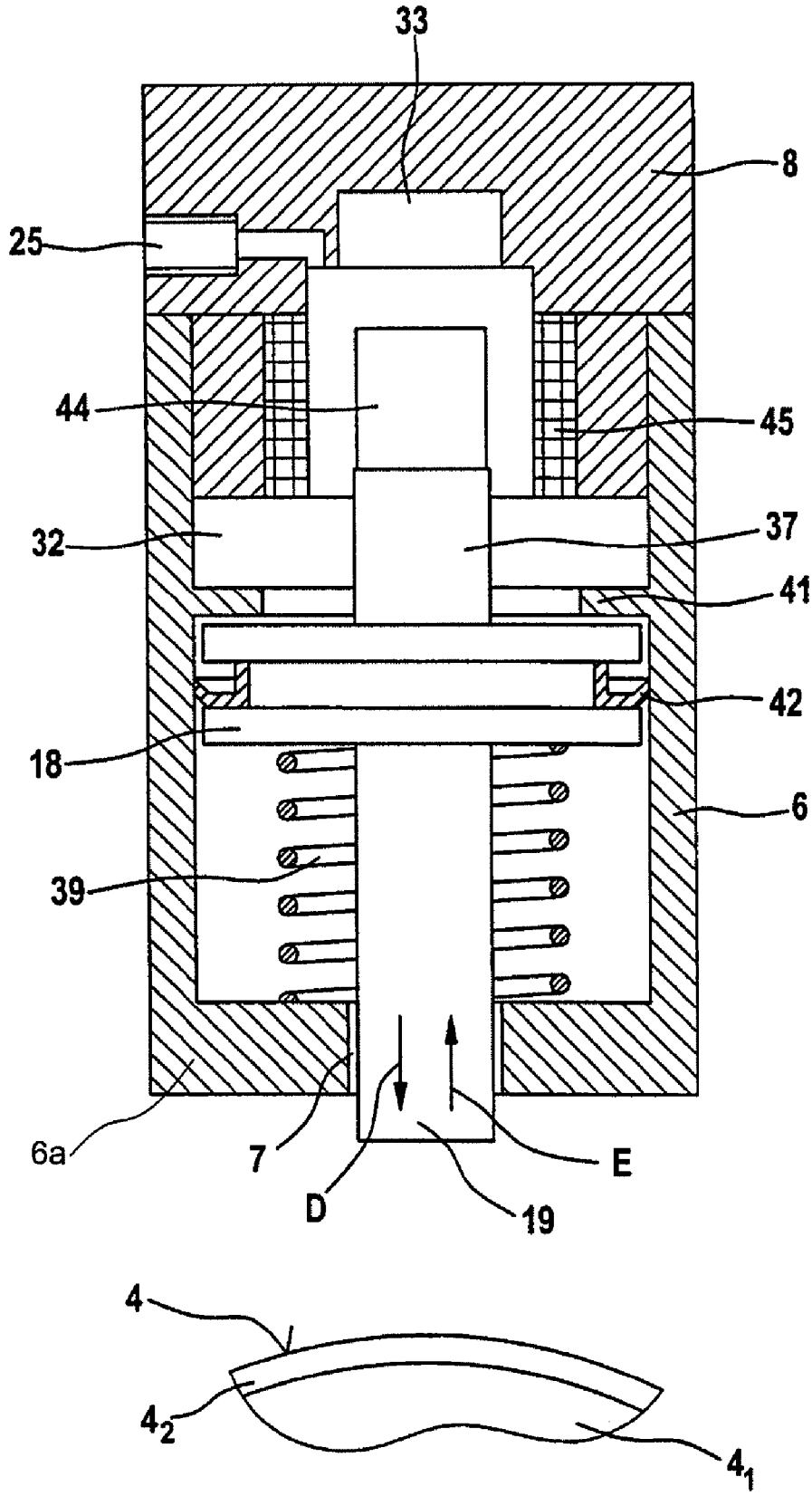
FIG. 4 is a section through one illustrative arrangement of an inductive displacement sensor in a pressure-medium system according to the invention.

FIG. 4 shows one form of presser element 9 in which there is a compressed-air-operated pressure-medium cylinder consisting of a cylinder housing 6 in which a piston 18 is arranged so as to be axially movable. A piston rod 19 (presser rod) extends from the piston 18. The piston rod 19 emerges from a cover-side opening 7 of the pot-shaped cylinder housing 6. The opening 7 and the inner wall of the cylinder housing 6 serve for guiding the piston 18 with the piston rod 19. The piston rod 19 cooperates—in the manner described at the beginning—with an upper roller 4 of a drafting system for fibre material. The upper roller 4 consists of a metal cylinder $4_1$, to which a roller covering $4_2$ (hollow cylindrical in cross-section) made of an elastomer is attached. The pot-shaped cylinder housing 6 is closed with respect to the end face remote from the opening 7 by a cylinder base 8. In this exemplary embodiment, the connection between the cylinder housing 6 and the cylinder base 8 is in the form of a clip connection. The cylinder base 8 has a pressure-medium connection 25 for acting upon a pressure chamber 32 of the pressure-medium cylinder. Furthermore, in the region of the pressure chamber 32, a guide recess 33 is provided in the cylinder base 8. The guide recess 33 corresponds with a cylindrical extension 37 which is screwed into the piston rod 19 coaxially therewith to form a lengthwise extension thereof. The corresponding screw connection 37 serves simultaneously also for attaching the piston 18 to the piston rod 19. A compression spring 39 is arranged between the piston 18 and the cover 6*a* of the cylinder housing 6. Using the spring-returnable piston 18, in the non-pressurised state the piston 18 is always returned to the end position by mechanical means.

The cylinder base 8 is provided for accommodating an inductive displacement sensor 43 which consists of a plunger core 44 and a plunger coil 45. The inductive plunger core 44 consists of a metal covering, for example, a metal coating, thin-walled metal cap, hollow cylinder or the like, which is applied over the outer free end of the cylindrical extension 37. The plunger core 44 moves back and forth in the guide recess 33 in the direction of arrows D, E. The inductive plunger coil 45 is in the form of a hollow cylinder, the outer wall surface of which is in contact with the cylindrical inner wall surface of the guide recess 33. The cylindrical inner wall surface of the fixed plunger coil 45 is located opposite and spaced apart from the cylindrical outer wall surface of the plunger core 44. By being used in the pressure chamber, the inductive displacement sensor 43 is protected from dust.

Furthermore, formed on the cylinder housing 6 there is a radially inwardly directed annular shoulder 41 which acts as upper end stop for the piston 18. Reference numeral 42 denotes a peripheral, approximately ring-shaped elastomeric seal between the piston 18 and the inner wall of the cylinder housing 6.

Figure 5:
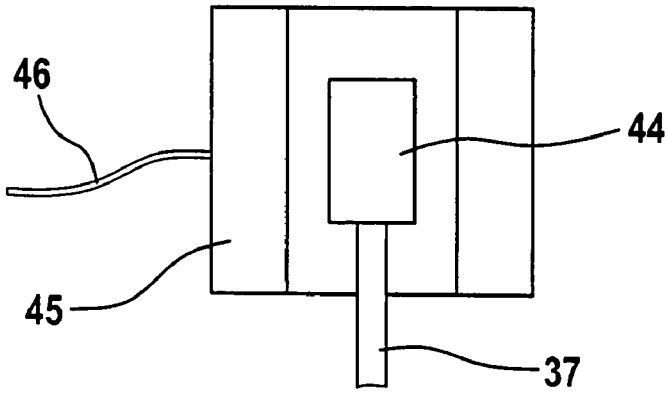
FIG. 5 is a diagrammatic view of the inductive displacement sensor of FIG. 4 with a plunger coil and a plunger core.
Figure 5A:
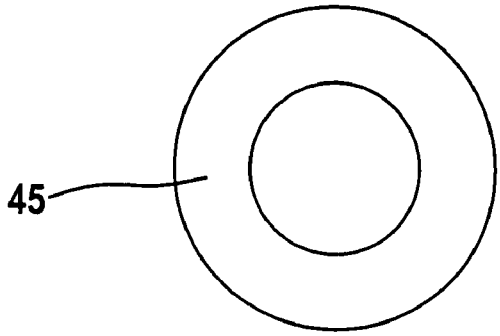
FIG. 5*a* is a plan view of the plunger coil of FIG. 5.

Referring now to the schematic illustration in FIG. 5, an electrical lead 46 is connected to the plunger coil 45. The plunger core 44, which is in the form of a solid metal cylinder, is attached to the free end of the extension 37 (for example made of plastics), for example by means of a screw connection. As shown in FIG. 5*a*, the plunger coil 45 is substantially annular in cross-section.

Figure 6:
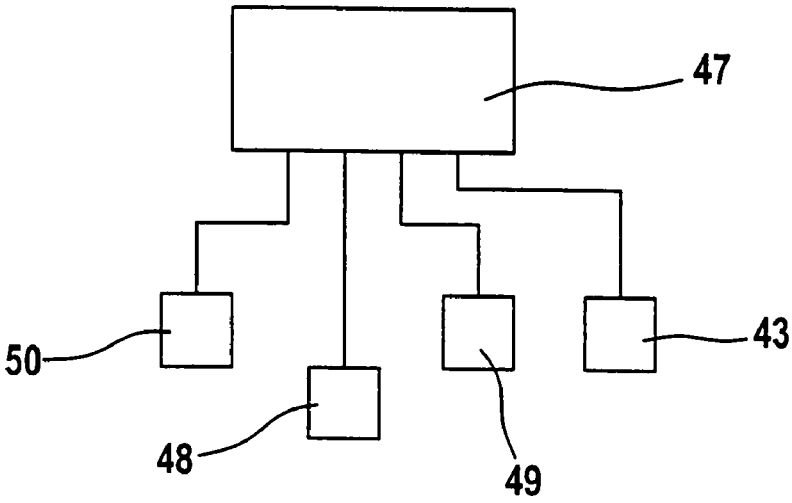
FIG. 6 is a diagrammatic block circuit diagram of an electronic control and regulation device (evaluation device) having an inductive displacement sensor, memory element, 4-channel evaluation means and display device.

In an exemplary control arrangement shown in FIG. 6, the inductive displacement sensor 43 (or via lead 46 the plunger coil 45) is connected to an electronic control and regulation device 47, for example a microcomputer having a microprocessor. Furthermore, the control and regulation device 47 is connected to a memory element 48 which is able to store the measured values of the inductive displacement sensor 43 and predetermined desired values, for example maximum and minimum values. In addition, a 4-channel evaluation device 49 and a display device 50 (lap and/or wear message) are connected to the control and regulation device 47.

Using the apparatus according to the invention, by means of the contact pressure of the piston rod 19 on the roller covering $4_2$ of the upper roller 4 and accordingly the determination of the position of the piston 18, it is possible for both lap and wear to be displayed.

Although the foregoing invention has been described in detail by way of illustration and example for purposes of understanding, it will be obvious that changes and modifications may be practised within the scope of the appended claims.

What is claimed is:

1. An apparatus on a drafting system of a spinning room machine, for weighting a drafting system roller, the apparatus comprising:

at least one pressure-medium system including:

a pressure-medium cylinder;

a piston acted upon by a pressure medium and axially movable inside the cylinder; and a piston rod connected to the piston and passing through an end of the cylinder to apply weighting to the roller, at least one inductive displacement sensor disposed within the pressure-medium system and configured to detect movements of the piston in two directions and produce a corresponding output signal;

an evaluation device coupled to the output signal and producing a displacement signal corresponding to a measured displacement of the piston; and an electronic control and regulation device coupled to the at least one inductive displacement sensor and configured to receive the displacement signal, wherein the electronic control and regulation device is adapted to compare the displacement signal to stored predetermined maximum and minimum values relating to allowable lap formation on the roller and wear to the roller, respectively.

2. The apparatus according to claim 1, wherein the predetermined maximum value comprises a freely programmable maximum value for upward excursion of the roller caused by lap formation, the apparatus further including a memory element coupled to the electronic control and regulation device to store the freely programmable maximum value, whereby the electronic control and regulation device is adapted to compare the displacement signal corresponding to movement of the piston to the maximum value for upward excursion of the roller to determine lap formation on the roller.

3. The apparatus according to claim 1, wherein the predetermined minimum value comprises a freely programmable minimum value for downward excursion of the roller caused by roller wear, wherein the minimum value relates to the minimum value for a diameter of the roller, and the apparatus further including a memory element coupled to the electronic control and regulation device to store the freely programmable minimum value, whereby the electronic control and regulation device is adapted to compare the displacement signal corresponding to movement of the piston to the minimum value for downward excursion of the roller to determine wear of the roller.

4. The apparatus according to claim 1, and further including a display device coupled to the electronic regulation and control device to display at least one of lap and wear information.

5. The apparatus according to claim 1, wherein the evaluation device comprises a 4-channel evaluation device.

6. A method for weighting a drafting system roller on a drafting system of a spinning room machine, comprising: utilizing the apparatus of claim 1.

7. An apparatus according to claim 1, wherein the at least one inductive displacement sensor comprises a plunger core and a plunger coil.

8. An apparatus according to claim 7, wherein the plunger core is movable and the plunger coil is in a fixed position.

9. An apparatus according to claim 7, further comprising a piston rod extension, attached to the piston at an end opposite the piston rod, wherein the plunger core is arranged in an end region of the piston rod extension.

10. An apparatus according to claim 7, wherein the cylinder includes a cylinder base portion having a guide recess, the plunger core arranged to move back and forth in the guide recess.

11. An apparatus according to claim 7, wherein the plunger core comprises a metal covering to cover at least a part of an extension mounted on the piston.

12. An apparatus according to claim 7, wherein the plunger core comprises a solid metal cylinder.

13. An apparatus according to claim 7, wherein the plunger coil comprises a hollow cylinder.

14. An apparatus according to claim 13, wherein a cylindrical inner wall surface of the plunger coil lies opposite and spaced apart from a cylindrical outer wall surface of the plunger core.

15. An apparatus according to claim 7, wherein the plunger coil seals a top of a pressure chamber defined in the cylinder.

16. An apparatus according to claim 7, wherein the at least one inductive displacement sensor is arranged in the cylinder of the pressure-medium system.

17. An apparatus according to claim 1, wherein the at least one inductive displacement sensor is connected to the electronic control and regulation device by an electrical lead.

18. An apparatus according to claim 1, wherein the at least one inductive displacement sensor is calibratable on each operation of closing the drafting system.

19. An apparatus according to claim 1, wherein the apparatus displays and stores measured values relating to lap formation and/or wear behaviour of the upper rollers.

20. An apparatus according to claim 1, wherein the drafting system comprises at least three upper rollers with a corresponding number of presser arms, each comprising the pressure-medium system.

21. An apparatus according to claim 1, wherein the pressure-medium system comprises a compressed air system and the pressure-medium cylinder comprises a compressed air cylinder.

22. A method for weighting a drafting system roller of a spinning room machine, comprising:

weighting said roller with a pressure-medium system comprising a pressure-medium cylinder and a piston which is acted upon by a pressure medium, wherein the piston is arranged so as to be axially movable inside the cylinder and wherein a piston rod connected to the piston passes through an end of the cylinder to apply weighting to the roller;

detecting movements of the piston in two directions with at least one inductive displacement sensor disposed within the pressure-medium system;

producing a displacement signal corresponding to a measured displacement of the piston by an evaluation device coupled to the output signal;

receiving the displacement signal by an electronic control and regulation device coupled to the at least one inductive displacement sensor; and comparing the displacement signal, by the electronic control and regulation device, to stored predetermined maximum and minimum values relating to allowable lap formation on the roller and wear to the roller, respectively.

23. The method of claim 22, further comprising:

displaying a message on a display device connected to the electronic control and regulation device, the message related to at least one of lap formation on the roller or wear to the roller.

24. The method of claim 22, wherein when the measured displacement value of the piston reaches or exceeds the stored predetermined maximum and minimum values relating to lap formation on the roller and wear to the roller, the method further comprising:

switching off the spinning room machine by the electronic control and regulation device.

* * * * *